US007728211B1

(12) United States Patent
Gatzen

(10) Patent No.: US 7,728,211 B1
(45) Date of Patent: Jun. 1, 2010

(54) SNARE DRUM END PLATE AND STRAP

(75) Inventor: Robert A. Gatzen, Newington, CT (US)

(73) Assignee: D'Addario & Company, Inc., Farmingdale, NY (US)

( * ) Notice: Subject to any disclaimer, the term of this patent is extended or adjusted under 35 U.S.C. 154(b) by 0 days.

(21) Appl. No.: 12/454,348

(22) Filed: May 15, 2009

(51) Int. Cl.
*G10D 13/02* (2006.01)

(52) U.S. Cl. ..... 84/415

(58) Field of Classification Search ..... 84/415
See application file for complete search history.

(56) References Cited

U.S. PATENT DOCUMENTS

| | | | | | |
|---|---|---|---|---|---|
| 4,018,130 | A * | 4/1977 | Gariepy, Sr. | ..... | 84/415 |
| 4,339,982 | A * | 7/1982 | Hoshino | ..... | 84/415 |
| 5,507,214 | A * | 4/1996 | Hoshino | ..... | 84/415 |
| 5,557,053 | A * | 9/1996 | Nickel | ..... | 84/415 |
| 5,616,875 | A * | 4/1997 | Lombardi | ..... | 84/415 |
| 5,844,157 | A * | 12/1998 | Kasha | ..... | 84/415 |
| 6,093,877 | A | 7/2000 | Nickel | ..... | 84/415 |
| 6,867,355 | B2 * | 3/2005 | Okamoto | ..... | 84/415 |
| 6,891,098 | B1 * | 5/2005 | Lombardi | ..... | 84/415 |
| 6,958,440 | B2 * | 10/2005 | Yu-Hwa | ..... | 84/415 |
| 7,202,405 | B2 * | 4/2007 | Takegawa | ..... | 84/415 |
| 7,439,433 | B1 | 10/2008 | Hsieh | ..... | 84/415 |
| 7,456,350 | B2 | 11/2008 | Neumayer et al. | ..... | 84/411 R |

* cited by examiner

*Primary Examiner*—Jeffrey Donels
*Assistant Examiner*—Robert W Horn
(74) *Attorney, Agent, or Firm*—Alix, Yale & Ristas, LLP

(57) ABSTRACT

A snare drum wire set comprises a generally rectangular rigid plate having a front, a back including a central region having an aperture, left and right sides, and a top and a bottom. The back has a support leg on each side of the central region and an elevated back edge that bridges the support legs in the central region. A mounting strap having a front end is secured in the aperture and extends backward beneath the elevated back edge. A plurality of snare wires are secured to the bottom of the front of the plate and extend forward in parallel from the front edge of the plate. The preferred quick-change strap with transverse insert pin can be very quickly inserted or removed from the clip.

18 Claims, 6 Drawing Sheets

SNARE DRUM END PLATE AND STRAP

BACKGROUND

The present invention relates to snare drums, and particularly to apparatus for mounting the snare wires to the drum shell.

The "drum set" is comprised of three types of drums: the bass drum, toms and snare drum. The snare drum is central to the drum set and distinctive both in function and design. The basic difference is in the design of the upper and lower bearing rims or edges of the drum shell, across which the drumhead vibrates. The upper bearing edge of the snare drum is shaped evenly (flat) around the 360-degree circumference while the bottom bearing edge has two cutouts (generally elliptical or semi-circular) positioned parallel to each other and 180 degrees apart. The cutout is called the "snare bed" and varies in length and depth depending the model and/or the manufacturer. This produces a "domed" type shape across the drumhead, crucial in maintaining intimate contact between the vibrating drumhead and the snare wires.

The snare wires are a set of coiled wires varying in material (although most are steel), coil pitch, wire quantity, gauge, shape, length, spacing between wires, and overall width. These variables control the amount and timbre of the "snare" sound as the drumhead and wires vibrate during play. The ends of each set of individual snare wires are fitted, often soldered, onto two opposite rectangular plates, often referred to as the "end plate" or "end-clip" which are situated within the bearing edge adjacent a respective cut out. Each clip is attached to a strap or cable which runs through the cutout and along the outside the shell, with one strap attached to the snare strainer and the other strap attached to a butt-end. The butt end holds one strap in fixed position relative to the edge while the strainer can selectively pull or release the other strap thereby changing the tension on the snare wires.

For the majority of snare drums, there are two types of end-clip designs, the "step" clip and the "curved" or "bent" end-clip. The choice between the two clip designs is subjective. The end-clips are designed to stretch the snare wires as evenly as possible laterally across the center of the drumhead and down into the snare bed. This creates intimate contact of the snare wires against the surface of the drumhead, insuring "snare response" from the center to the edge.

The traditional dual strap-type connector is difficult to mount and adjust. It requires perfectly even tension applied to each cable end to properly "seat" the snare wires and insure that all wire strands receive equal tension. The single strap method also has its shortcomings. Once the strap passes under the back end of the clip it creates a surface that is at a different elevation than the back of the clip, creating a pivot axis and a "see-saw" effect that destabilizes the connection between the clip and snare wires to the head surface during performance. The above mounting methods described create inconsistency in sound and are difficult to properly adjust.

SUMMARY

The present disclosure is directed to several aspects of the invention, which are preferably but not necessarily combined.

One aspect is directed an inventive clip, before the wires are attached during manufacture of the snare wire set.

Another aspect is directed to an inventive snare wire set comprising the combination of inventive clip and attached snare wires.

Yet another aspect is directed to a snare drum wire kit comprising the inventive or conventional clip in combination with an inventive, quick change strap.

In a further aspect, the quick-change strap alone is inventive with respect to the intended end use.

The clip comprises a generally rectangular rigid plate having a front to which snare wires are attachable and a back including a central region having an aperture to which a holding strap is attachable. A pair of legs with substantially flat feet at the back straddle the central region. The feet define the bottom most elevation $e_0$ of the clip when the clip rests flat on the feet (i.e., when the clip with wires and strap is eventually mounted to the drumhead). When the feet are on a flat surface, the back edge at the central region is at an elevation $e_1$ above the feet and a front edge is at an elevation $e_2$ above the feet.

The snare drum wire set comprises a generally rectangular rigid plate having a front, a back including a central region having an aperture, left and right sides, and a top and a bottom. The back has a support leg on each side of the central region and an elevated back edge that bridges the support legs in the central region. A mounting strap having a front end is secured in the aperture and extends backward beneath the elevated back edge. A plurality of snare wires are secured to the bottom of the front of the plate and extend forward in parallel from the front edge of the plate.

The snare drum wire kit comprises a generally rectangular rigid plate having a front to which snare wires are attached, and a back including a central region having an elongated aperture through which a holding strap is attachable. The holding strap has a front end formed as a transverse loop with a width no greater than the length of the aperture, and a pin having a length greater than the length of the aperture and passing or insertable through the loop. To assemble the strap with the wire set, the loop with inserted pin is placed in the aperture so that end portions of the pin extend beyond the aperture and overlie the plate.

With the present invention, the pressure is more equalized or balanced, with regard to both lateral stabilization of the snare wires and contact with the head surface. There are three distinct benefits that can be achieved: (1) equal pressure from side to side on the clip, (2) specific contact between the snare wires and the drumhead, and (3) quicker change of the snare wires.

With respect to equal pressure, the difference between the traditional curved clip design and the present invention is that the two feet at the back corners of the clip raise the back of the clip, creating a bridge relative to the remainder of the clip. The strap passes under the bridge, without creating a pivot. The lateral or rocking motion of the snare wires is eliminated, producing consistency in sound.

The preferred quick-change strap with transverse insert pin can be very quickly inserted or removed from the clip. Another advantage when used with the preferred strap is an increased downward pressure of the snare wires against the drumhead surface using leverage. By passing the strap under the backside of the clip, the back of the clip is urged upwardly while the insert pin at the end of the strap applies downward pressure across the center of the clip, increasing the amount of pressure of the wires against the head.

By lifting the backside of the clip at the corners, the snare wires are also elevated off the edge of the head, localizing the contact closer to the drumhead center where the up and down "piston" type motion of the drum head is maximized while pitch sustain is undetectable. This is analogous to a large tree, where the trunk (center of the drumhead) is void of vibration (harmonic overtones) and branches (edge of drumhead) constantly in motion. Varying the height of the back feet on the clip controls this adjustment. The distinct advantage of this design is that it eliminates snare wire vibration in close proximity to the snare bed, significantly reducing sympathetic snare buzz.

Sympathetic snare buzz is an after-ring of the snare wires generated by the harmonic overtones at the edge of the drumhead at the tail end of the decay. Toms being struck in close proximity to the snare drum can also cause unwanted sympathetic snare buzz, which drummers view as an aggravation and impossible to control. Drummers will try a variety of methods to eliminate this sympathetic snare buzz, from detuning the bottom head to applying tape and other crude damping devices with the goal of eliminating these overtones. These methods fail to fully control sympathetic snare buzz and are a further detriment as they limit the sonic potential of the instrument, undermining the desired nature of the tone.

Both the traditional cable and strap hold-down methods are tedious to adjust as well as time-consuming for changing snare wires. This is due to the connectors having to be released from both the snare strainer and butt-end or anchor, usually requiring tools such as a screwdriver or drum key. With the improved strap and pin design, the strap can pass through the aperture or slot on the clip, releasing both ends of the snares without upsetting the strap positions in the two holders. This capability to change the snare without tools is especially useful for drummers requiring variations in snare sounds for orchestral and marching formats, and in recording studio environments where time is directly related to cost.

BRIEF DESCRIPTION OF THE DRAWING

An embodiment will be described in greater detail with reference to the accompanying drawing, in which.

DETAILED DESCRIPTION

Figure 1:
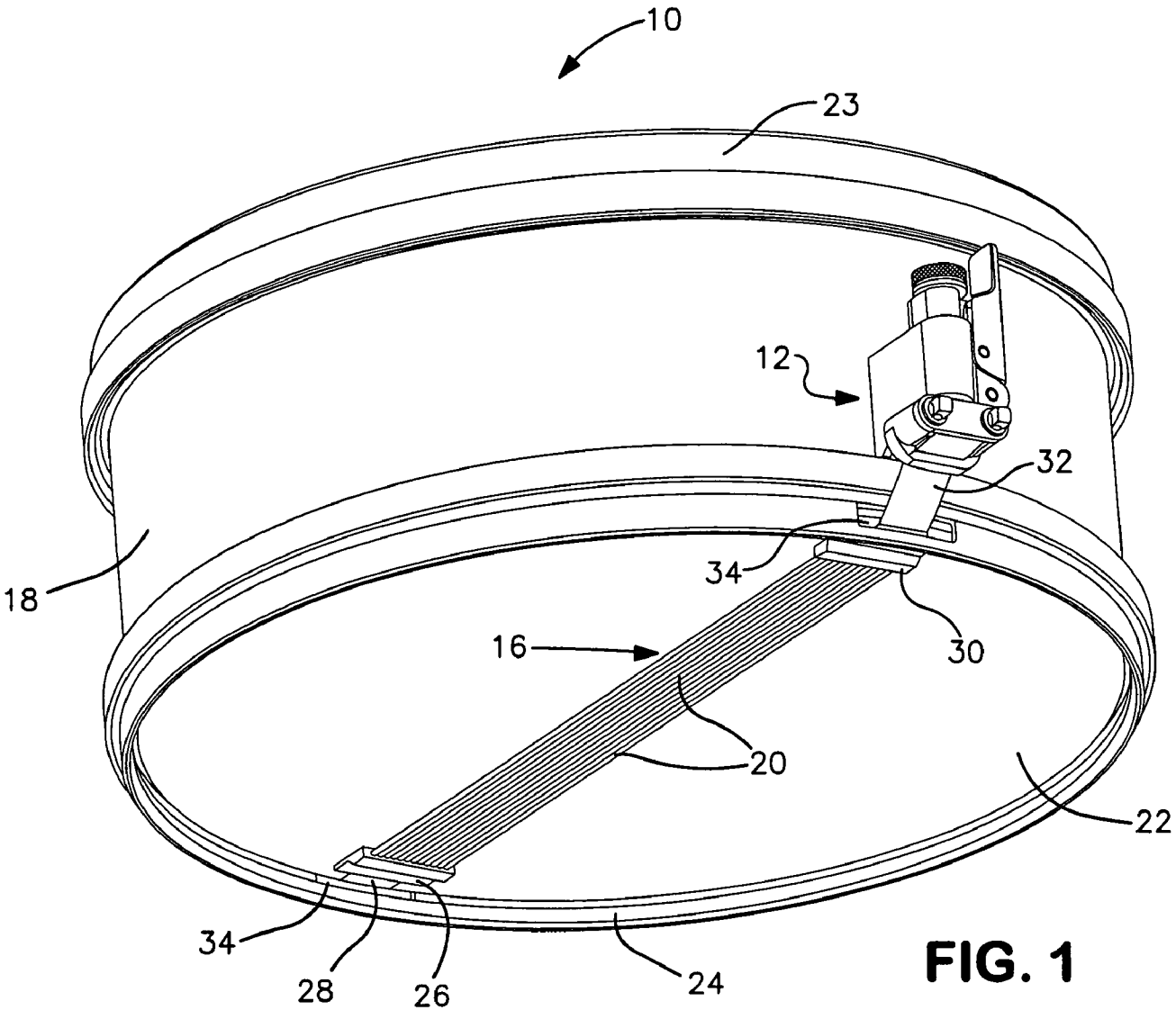
FIG. 1 is a perspective view from below a snare drum, showing the overall configuration of the snare assembly incorporating the present invention.
Figure 2:
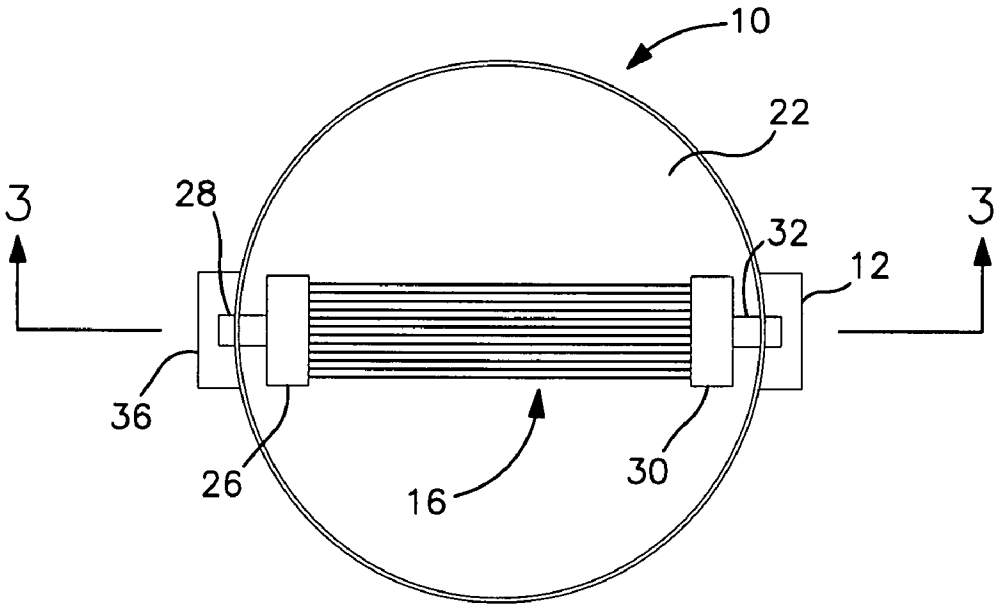
FIG. 2 is a schematic bottom view of the snare drum of FIG. 1.

FIGS. 1 and 2 show a snare drum 10 with snare strainer 12 and snare butt or anchor 14 attached to a snare unit or assembly 16. As is conventional, the drum 10 includes a shell 18 with the wires or snares 20 of the snare unit 16 positioned against the bottom drumhead 22 of the drum. The drumheads are held in position against the shell by rims 24 at the top and bottom of the shell.

The opposite ends of the snare wires 20 are held by the stationary snare clip 26 connected by a strap 28 and a shiftable snare clip 30 connected by a strap 32 with the straps passing through notches or cutouts 34 in the rim 24. The strap 28 of stationary clip 26 is held by a clamp to an anchor or butt bracket 36 which is fastened to the shell 18. The shiftable clip 30 is connected by its strap 32 to strainer 12.

The overall configuration of a typical snare drum is described in U.S. Pat. Nos. 6,093,877 and 5,557,053, the disclosures of which are hereby incorporated by reference.

Although a snare drum as purchased would include the snare unit 16, most performers purchase a variety of snare units having different types of wires, with respective distinctive sound qualities. Each snare unit as purchased typically includes the snare wires 20 connected to one end of each clip 26, 30, and corresponding two straps 28, 32. As will be described in greater detail below, with the present invention, the same straps 28, 32 can be used for each of the different snare units 16.

Figure 3:
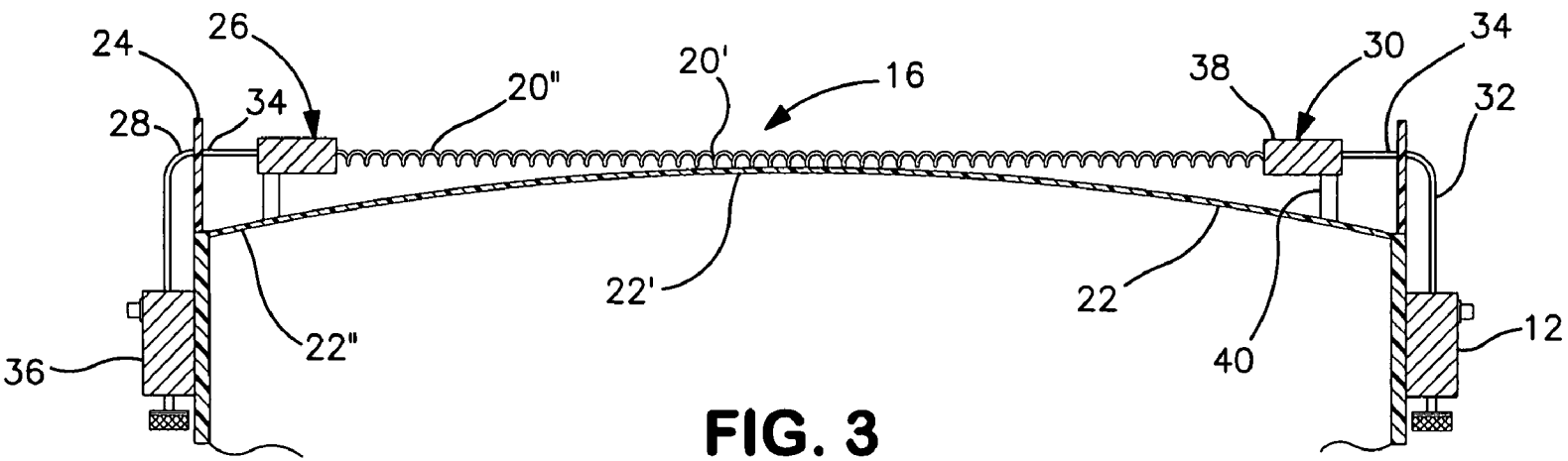
FIG. 3 is a schematic cross section view of the bottom of the snare drum along line 3-3 FIG. 2.

FIG. 3 represents one improvement obtained with the present invention, relative to the state of the art. A cross-section of the lower drumhead is shown, with the drum inverted so that the bottom drumhead 22 has the snare unit 16 thereover. Each of the clips 26, 30 is shown schematically as having a front portion 38 to which the snare wires are attached, and a back portion 40 which rests on the membrane of the drumhead 22. It is conventional for the lower drumhead to be secured to the shell so as to assume a dome shape, having a broad apex 22' in the central region and a radially outer region 22' mounted on the rim on which the clips 26, 30 rest. The front portion 38 of each clip is above the membrane, as are the snare wires for a distance of at least about one inch from each clip toward the apex 22'. The back portion 40 is shown with legs perpendicular to the front portion 38 of each clip, but this is a functional representation. The holding of the wires above the outer portion of the membrane such as illustrated at 20", avoids the undesirable sympathetic snare buzz.

In the preferred embodiment there is an oblique transition defining a central region between front and back portions 38, 40 from which the straps 28, 32 extend outwardly into securement at anchor 36 and strainer 12 respectively. Importantly, the straps 28, 32 are attached to the respective clips 26, 30 at an elevation such that the straps can be tensioned without the clip applying any pressure to the strap against the drumhead. This avoids the undesirable situation of the strap providing a fulcrum about which the clip can tilt.

Figure 4:
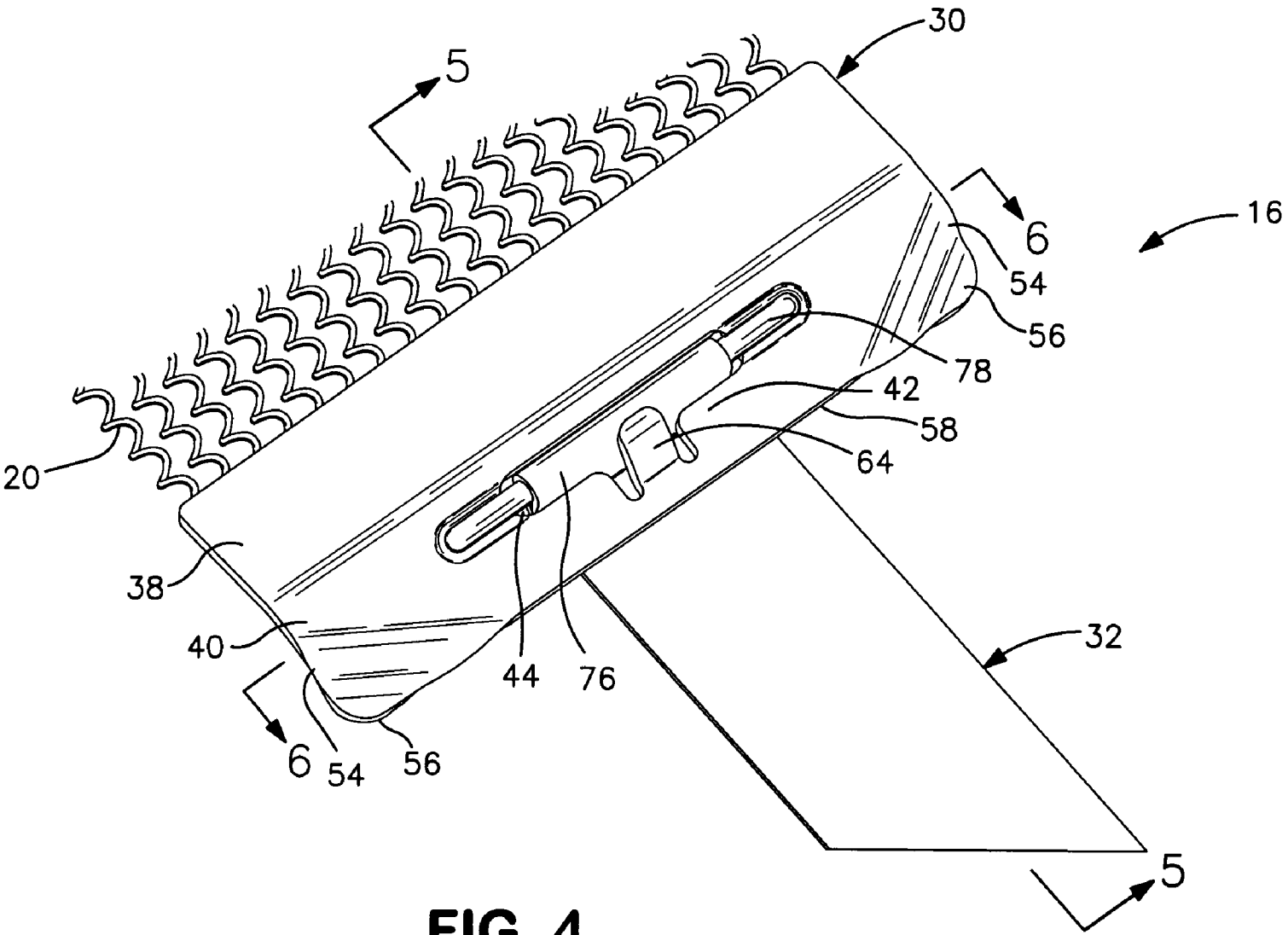
FIG. 4 is a perspective view from above, of the right portion of the snare assembly of FIG. 3.
Figure 5:
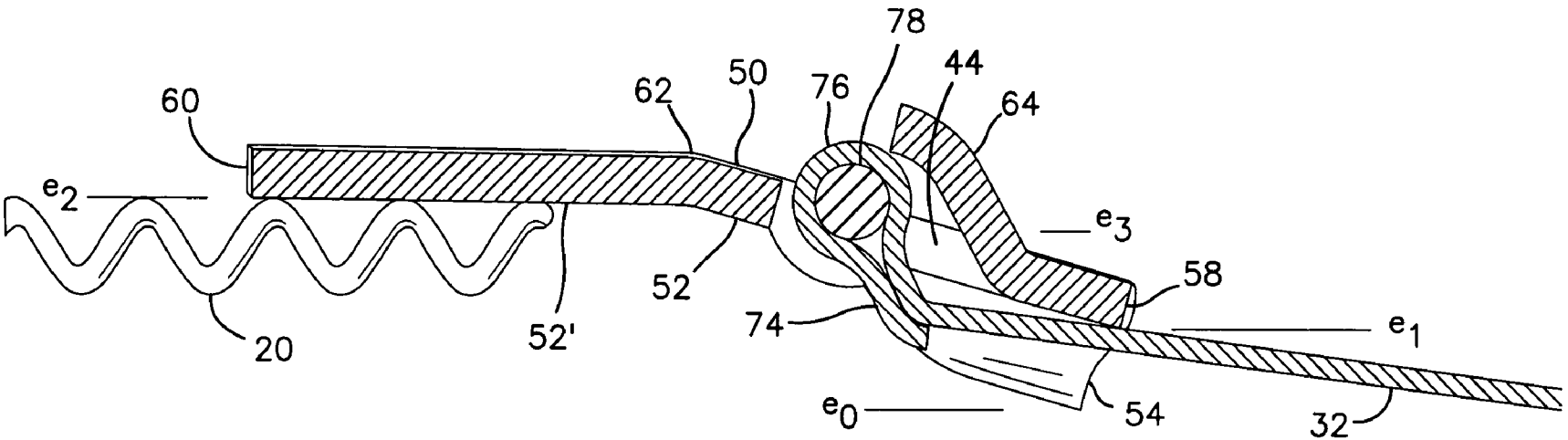
FIG. 5 is an illustrative cross sectional view along line 5-5 of the portion of the snare assembly shown in FIG. 4.
Figure 6:
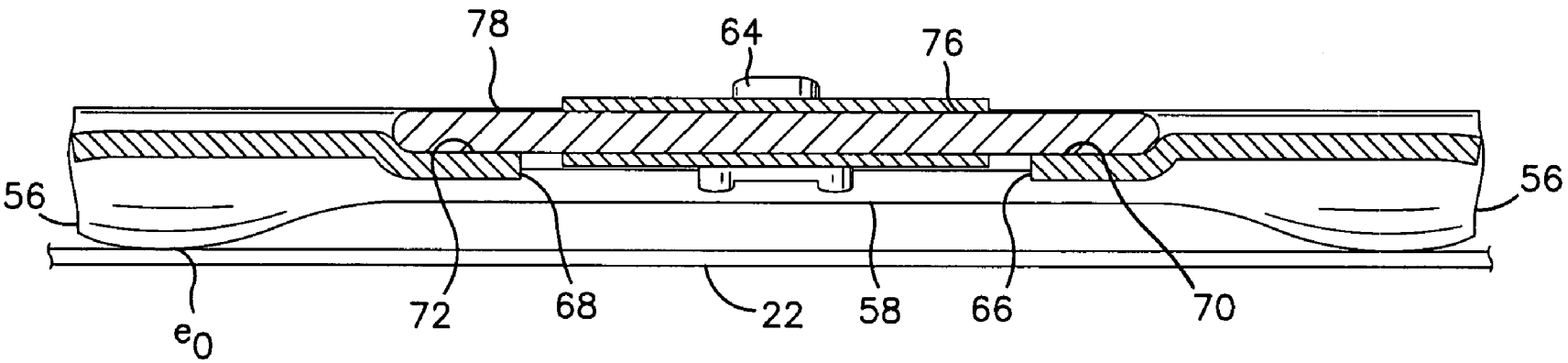
FIG. 6 is a cross sectional view taken along line 6-6 of FIG. 4.
Figure 7:
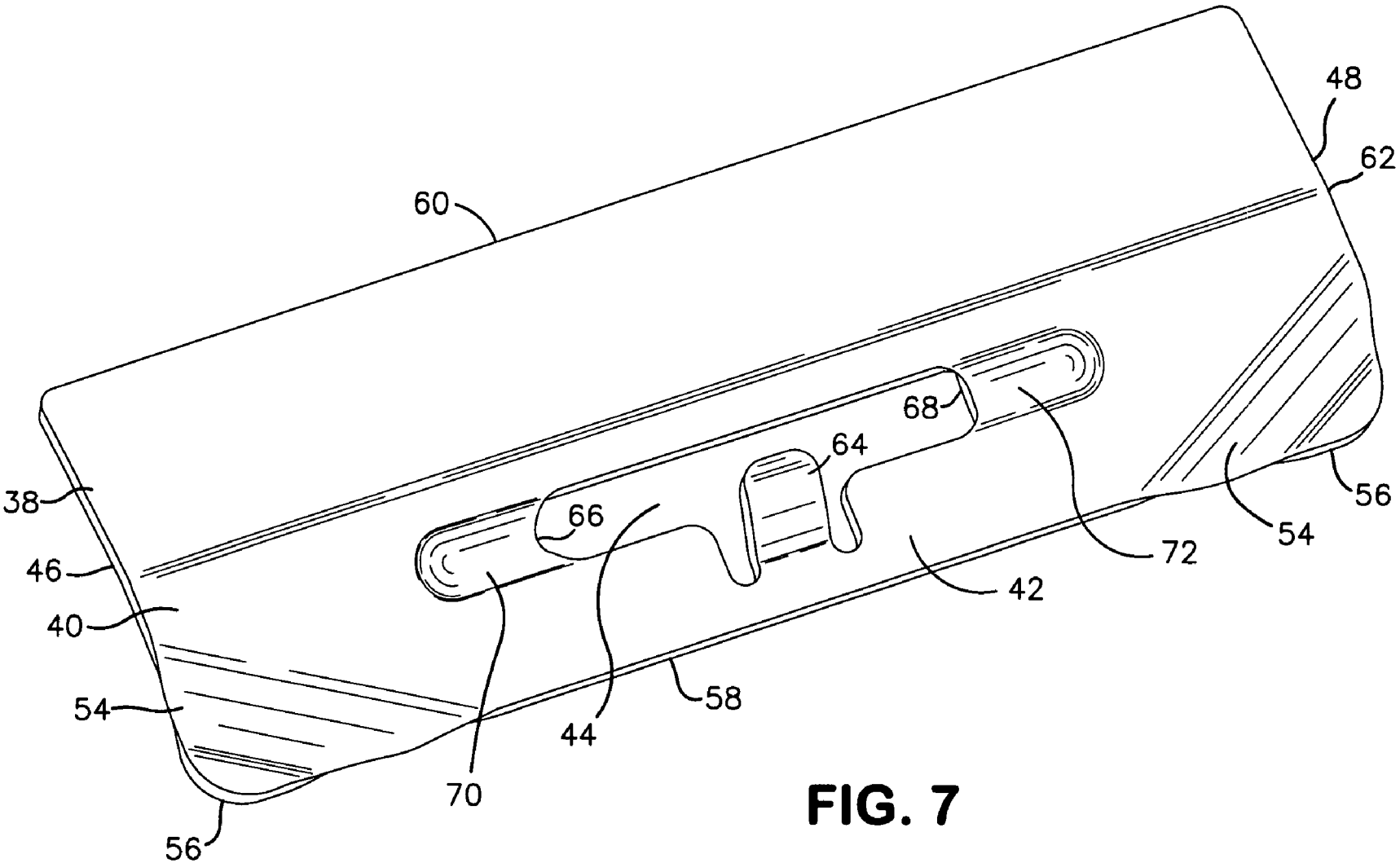
FIG. 7 is a view similar to FIG. 4, of only the clip component of the snare assembly.

The preferred implementation of the overall inventive concept as shown in FIG. 3, will be described with reference to FIGS. 4-7. FIGS. 4-6 show the preferred snare unit 16 including snare wires 20, one clip 30, and its associated strap 32, whereas FIG. 7 shows the preferred clip 30 before attachment of the snare wires 20 and strap 32. Clips 26 and 32 are preferably identical.

The clip 30 is in the form of a generally rectangular rigid plate having a front 38 to which the snare wires 20 are attached or attachable, a back 40 including a central region 42, having an aperture 44 to which the holding strap 32 is attachable, left and right sides 46, 48, and top and bottom 50, 52. A pair of legs 54 with substantially flat feet 56 at the back, straddle the central region 42. The feet define the bottom most elevation when the clip rests flat on the feet 56. The back edge 58 is at an elevation $e_1$ above the feet at the central region, relative to elevation $e_0$ when the clip rests on the feet. The front edge 60 is at an elevation $e_2$ above elevation $e_0$ of the feet when the clip rests flat on the feet. The legs are preferably integrally formed by bending over the back corners of the rectangle and then further bending to form the feet 56. As a consequence, the back edge 58 in the central region 42 bridges the legs at elevation $e_1$ above the reference or base elevation $e_0$ of the feet. This elevation $e_1$ should be at least equal to and preferably greater than the thickness of the strap 32, thereby assuring that as the snare unit is tensioned, the back edge 58 will not push the strap against the membrane, between the feet. In this way, equal pressure is applied by each foot 56 without any rocking or tilting.

The clip is preferably formed with a bend line 62 extending between the left and right sides 46, 48, located between the aperture 44 and the front edge 60, with the central region 42 extending obliquely from the back edge 58 to the bend line 62. The front 38 of the plate extends with a substantially flat front bottom surface 52' from the bend line 62 to the front edge 60, and the ends of the snare wires are welded, soldered or otherwise attached in a conventional manner to the bottom surface 52'. In this embodiment, the aperture 44 is at an elevation $e_3$ between the reference elevation $e_0$ of the feet 56 and elevation $e_2$ of the front bottom surface 52'.

As most evident in FIG. 7, the aperture 44 is elongated in a direction between the sides 46, 48 of the plate and a rigid tab 64 preferably extends upwardly from the central region 42 of the back of the plate, partially overlying the aperture. The aperture has left and right edges 66, 68 and respective left and right recesses 70, 72, which extend from the edges of the aperture toward the sides of the plate.

As best shown in FIGS. 4 and 5, the preferred mounting strap 32 has a front end 74 secured in the aperture 44 and extending backward beneath the elevated back edge 58. The front end of the strap is formed as a transverse loop 76 situated in the aperture and having a width no greater than the length of the aperture. A pin 78 passes through the loop with end portions extending from the loop and respectively supported in the recesses 70, 72. In this configuration, when tension is applied to the strap 32 during mounting of the snare unit, the recesses and tab keep the loop within the aperture.

It should be appreciated that the clip of FIG. 7 with or without the tab 64 or recesses 70, 72, could be employed with conventional straps (not shown) that loop through the aperture and pass over the central region 42 equally, such that both ends of one strap extend from a first clip to the anchor on the shell and both ends of another strap extend from the second clip to a strainer on the shell in a conventional manner. With the back edge raised according to the invention, even a conventional strap would remain above elevation $e_0$ and thereby achieve the equal pressure at feet 56, while avoiding the rocking or tilting so common in the conventional snare drum. Similarly, a clip according to the invention without the tab and/or recesses would provide the attachment of the wires to the bottom of the front portion of the clip at an elevation $e_2$ above reference elevation $e_0$, thereby keeping the snare wires above the periphery of the drumhead and thus avoiding sympathetic vibration.

The strap 32 shown in FIGS. 4 and 5 is well suited to quick change-out of the snare unit 16, by simply loosening the strainer, pulling one exposed end of pin 78, and pushing the other end of the pin through the aperture followed by the held end thereby removing the strap entirely from the aperture. Another snare unit can quickly be installed by reversing the operation, i.e., inserting one end of the pin 78 up through the aperture sufficiently to pass the loop and other end through the aperture at an angle, then straightening the pin so that the ends of the pins lie within the recess 70, 72. The strainer is then reset and the drum is ready for play. This change-out can be made in less than one minute, whereas, conventionally the change-out would take at least 15 minutes.

In another aspect of the invention, the strap 32 can be used with a conventional clip, which has the aperture 44 shown in FIG. 7, but not the recesses 70, 72 or tab 64. The installation and removal would be as described above, except the ends of the pin 78 would lie on the flat surface of the conventional clip and the added support of the tab 64 would not be present. Such implementation would enable the quick change-out of snare units, but would not provide the advantages of the elevated back edge 58, which avoids pressure on the strap 32 against the membrane and likewise would not provide the advantage of elevating the snare wires 20 above the periphery of the drumhead. Nevertheless, the quick change-out is a significant improvement relative to the current state of the art.

This last aspect of the invention can be implemented in a snare drum wire kit, comprising a generally rectangular rigid plate having a front 38 to which snare wires are attached, and a back 40 including a central region 42 having an elongated aperture 44 through which a holding strap 32 is attachable. The holding strap 32 has a front end 74 formed as a transverse loop having a width no greater than the aperture. A pin 78 is provided with or in the loop, having a length greater than the aperture. When the loop with inserted pin is placed in the aperture, the end portions of the pin extend beyond the aperture and overly the plate, while the remainder of the strap passes under the back edge of the plate.

The invention claimed is:

1. A snare drum wire clip comprising:

a generally rectangular rigid plate having a front to which snare wires are attachable, a back including a central region having an aperture to which a holding strap is attachable, left and right sides, and a top and a bottom;

a pair of legs with substantially flat feet at the back, straddling the central region, said feet defining the bottom most elevation $e_0$ of the clip when the clip rests flat on said feet;

a back edge, which at said central region is at an elevation $e_1$ above the feet when the clip rests on said feet; and a front edge, which is at an elevation $e_2$ above the feet when the clip rests flat on said feet.

2. The clip of claim 1, wherein the plate has a bend line extending between the left and right sides, and located between the aperture and the front edge, with the central region extending obliquely from the back edge to the bend line.

3. The clip of claim 2, wherein the front of the plate extends with a substantially flat front bottom surface from the bend line to the front edge.

4. The clip of claim 3, wherein the aperture is at an elevation $e_3$ between the feet and the front bottom surface.

5. The clip of claim 1, wherein, the aperture is elongated in a direction between the sides of the plate; and a rigid tab extends upwardly from the central region of the back of the plate, partially overlying said aperture.

6. The clip of claim 1, wherein the aperture has left and right edges, and respective left and right recesses extend from the edges of the aperture toward the sides of the plate.

7. The clip of claim 6, wherein a rigid tab extends upwardly from the central region of the back of the plate, partially overlying said aperture.

8. A snare drum wire set comprising:

a generally rectangular rigid plate having a front, a back including a central region having an aperture, left and right sides, and a top and a bottom;

said back having a support leg on each side of the central region and an elevated back edge that bridges the support legs in the central region;

a mounting strap having a front end secured in the aperture and extending backward beneath the elevated back edge;

a plurality of snare wires secured to the bottom of the front of the pate, and extending forward in parallel from the front edge of the plate.

9. The wire set of claim 8, wherein each leg has a substantially flat foot at the back, on each side of the central region, said feet defining the bottom most elevation of the clip when the clip rests on said feet;

the back edge at said central region and said strap are at an elevations above the feet when the clip rests on said feet; and the front edge and the wires are at elevations above the feet when the clip rests on said feet.

10. The wire set of claim 8, wherein the plate has a bend line extending between the left and right sides, between the aperture and the front edge, with the central region extending obliquely from the back edge to the bend line;

the front of the plate extends with a substantially flat front bottom surface from the bend line to the front edge; and the aperture is at an elevation between the feet and the front bottom surface.

11. The wire set of claim 8, wherein the aperture is elongated in a direction between the sides of the plate; and a rigid tab extends upwardly from the central region of the back of the plate, partially overlying said aperture.

12. The wire set of claim 11, wherein the aperture has length defined between left and right edges, and respective left and right recesses extent from the edges of the aperture toward the sides of the plate.

13. The wire set of claim 12, wherein the front end of the strap is formed as a transverse loop situated in said aperture and having a width no greater than the length of the aperture;

a pin passes through the loop with end portions extending from the loop and respectively supported in said recesses;

whereby when tension is applied to the strap during mounting of the wire set to a snare drum, the recesses and tab keep the loop within the aperture.

14. The wire set of claim 8 as mounted to a drum shell over a domed snare drumhead, wherein the snare wires have first and second opposite ends;

the first ends of the wires are secured to a first said plate and the second ends of the wires are secured to a second said plate, with a first said strap attached to the first plate and a second said strap attached to the second plate;

each strap passes through a respective cut out in a rim of the drum shell and is tensioned between an anchor on the drum shell holding the first strap and a strainer on the drum shell holding the second strap;

whereby the snare wires are drawn against the apex of the dome but remain spaced from the drumhead for at least about one inch from each plate toward the apex.

15. The wire set of claim 8, as mounted to a drum shell over a domed snare drumhead, wherein the snare wires have first and second opposite ends;

the first ends of the wires are secured to a first said plate and the second ends of the wires are secured to a second said plate, with a first said strap attached to the first plate and a second said strap attached to the second plate;

each strap passes through a respective cut out in a rim of drum shell and is tensioned between an anchor on the drum shell holding the first strap and a strainer on the drum shell holding the second strap;

whereby the support legs of each plate contact the drumhead with substantially equal pressure without the back edge of the plate applying any pressure to the strap against the drumhead.

16. The snare wire set of claim 15, as mounted to a drum shell over a domed snare drumhead, wherein the snare wires are drawn against the apex of the dome but remain spaced from the drumhead for at least about one inch from each plate toward the apex.

17. The snare wire set of claim 16, as mounted to a drum shell over a domed snare drumhead, wherein, the aperture is elongated in a direction between the sides of the plate with a length defined between left and right edges;

a rigid tab extends upwardly from the central region of the back of the plate, partially overlying said aperture;

respective left and right recesses extend from the edges of the aperture toward the sides of the plate;

the front end of the strap is formed as a transverse loop situated in said aperture and having a width no greater than the length of the aperture;

a pin passes through the loop with end portions extending from the loop and respectively supported in said recesses;

whereby with said tensioning of the straps the recesses and tab keep the loop within the aperture.

18. A snare drum wire kit comprising:

a generally rectangular rigid plate having a front to which snare wires are attached, and a back including a central region having an elongated aperture through which a holding strap is attachable;

a holding strap having a front end formed as a transverse loop having a width no greater than the length of the aperture;

a pin having a length greater than the length of the aperture and passing or insertable through the loop;

whereby when the loop with inserted pin is placed in said aperture, end portions of the pin extend beyond the aperture and overlie the plate.

* * * * *